US010175594B2

(12) United States Patent
Nakatani et al.

(10) Patent No.: US 10,175,594 B2
(45) **Date of Patent: *Jan. 8, 2019**

(54) TONER SET

(71) Applicant: ZEON CORPORATION, Tokyo (JP)

(72) Inventors: Hiroshi Nakatani, Tokyo (JP); Takeru Chiba, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/946,155

(22) Filed: Apr. 5, 2018

(65) Prior Publication Data

US 2018/0224762 A1 Aug. 9, 2018

Related U.S. Application Data

(63) Continuation of application No. 15/129,330, filed as application No. PCT/JP2015/059472 on Mar. 26, 2015, now Pat. No. 9,958,798.

(30) Foreign Application Priority Data

Mar. 28, 2014 (JP) ..... 2014-070204

(51) Int. Cl.

| | |
|---|---|
| ***G03G 9/097*** | (2006.01) |
| ***G03G 9/08*** | (2006.01) |
| ***G03G 9/09*** | (2006.01) |
| ***G03G 9/107*** | (2006.01) |

(52) U.S. Cl.

CPC ..... *G03G 9/0823* (2013.01); *G03G 9/0819* (2013.01); *G03G 9/09* (2013.01); *G03G 9/097* (2013.01); *G03G 9/09708* (2013.01); *G03G 9/09725* (2013.01); *G03G 9/107* (2013.01)

(58) Field of Classification Search

CPC ..... G03G 9/0823; G03G 9/09725; G03G 9/09708; G03G 9/0918; G03G 9/091; G03G 9/092; G03G 9/09

USPC ..... 430/107.1, 45.5, 45.51, 45.55

See application file for complete search history.

(56) References Cited

U.S. PATENT DOCUMENTS

| | | | |
|---|---|---|---|
| 6,150,062 A | 11/2000 | Sugizaki | |
| 6,312,862 B1 | 11/2001 | Okado et al. | |
| 7,521,160 B2 | 4/2009 | Ohmura | |
| 9,958,798 B2 * | 5/2018 | Nakatani | G03G 9/0823 |
| 2006/0240350 A1 | 10/2006 | Shu et al. | |
| 2012/0171602 A1 | 7/2012 | Yoon | |

FOREIGN PATENT DOCUMENTS

| | | |
|---|---|---|
| JP | 09-101627 A | 4/1997 |
| JP | 2000-199983 A | 7/2000 |
| JP | 2001-005211 A | 1/2001 |
| JP | 2001-005212 A | 1/2001 |
| JP | 2001-255691 A | 9/2001 |
| JP | 2002-323786 A | 11/2002 |
| JP | 2003-149850 A | 5/2003 |
| JP | 2005-134807 A | 5/2005 |
| JP | 2005-321589 A | 11/2005 |
| JP | 2006-323368 A | 11/2006 |

OTHER PUBLICATIONS

International Search Report dated Jun. 2, 2015, issued in counterpart International Application No. PCT/JP2015/059472.

Notification of Transmittal of Translation of the International Preliminary Report on Patentability (Form PCT/IB/338) of International Application No. PCT/JP2015/059472, dated Oct. 13, 2016, with Forms PCT/IB/373 and PCT/ISA/237.

Non-Final Office Action dated Jul. 31, 2017, issued in U.S. Appl. No. 15/129,330.

Notice of Allowance dated Jan. 26, 2018, issued in U.S. Appl. No. 15/129,330.

* cited by examiner

*Primary Examiner* — Janis L Dote

(74) *Attorney, Agent, or Firm* — Westerman, Hattori, Daniels & Adrian, LLP

(57) ABSTRACT

There is provided a toner set including a yellow toner, a cyan toner and a magenta toner, the toners each comprising an external additive and colored resin particles comprising a binder resin, a colorant and a charge control agent. An absolute value of an average of q/d for any of the yellow, cyan and magenta toners is expressed by charge amount q (fC) and particle diameter d (μm). It is obtained by measurement using an electric field detachment-type charge amount distribution measurement device. It is in a range of 2.0 to 6.5 fC/10 μm, and a standard deviation (SD) of q/d is 13 fC/10 μm or less. A difference between average values of q/d for any two of the yellow, cyan and magenta toners is 2.0 fC/10 μm or less. A difference (ΔSD) between standard deviations of q/d for the two toners is 5.0 fC/10 μm or less.

2 Claims, No Drawings

TONER SET

CROSS-REFERENCE TO RELATED APPLICATION

The application is a Continuation of U.S. patent application Ser. No. 15/129,330, filed on Sep. 26, 2016, which is a 371 of International Application No. PCT/JP2015/059472, filed on Mar. 26, 2015, which is based on Japanese priority application No. 2014-070204 filed on Mar. 28, 2014.

TECHNICAL FIELD

The present invention relates to a toner set with a combination of toners for developing electrostatic images (hereinafter, simply referred to as "toner") which are used to develop, for example, an electrostatic latent image in electrophotography, electrostatic recording and electrostatic printing, and more particularly relates to a toner set that is excellent in fine line reproducibility and color reproducibility when the toners are superimposed and printed.

BACKGROUND ART

In image forming devices such as an electrophotographic device, an electrostatic recording device, and an electrostatic printing device, an image formation method which forms a desired image by developing an electrostatic latent image to be formed on a photo conductor with a toner for developing electrostatic images is widely performed. The method is applied to a copier, a printer, a facsimile and their composite machines thereof.

For example, in the electrophotographic device using electrophotography, in general, the surface of a photoconductor consisting of a photoconductive substance is uniformly charged by various means, and then an electrostatic latent image is formed on the photoconductor. Subsequently, the electrostatic latent image is developed using a toner, and the toner image is transferred onto a recording material such as a sheet of paper, and the material is heated so as to fix the image, whereby a copy is obtained.

As for the toner used in an image forming device, in order to improve functions such as the charge stability and fluidity of toner, external additives, such as inorganic particles and organic particles having a particle diameter lower than that of colored resin particles (toner particles) are generally attached and added onto the surface of toner particles (external addition) before use.

In the toner obtained using the conventional external additive, it is sometimes hard to obtain a charge rising property of toner at an early stage of printing. Particularly, the charge rising property of toner is easily influenced by the usage environment in a severe environment such as a low temperature and low humidity environment or a high temperature and high humidity environment. As a result, the image quality is easily deteriorated by fogging at the early stage, and an adverse effect is given to early-stage printing performance.

In the continuous printing process of a large number of sheets, mechanical stress in a development device (the number of times of contact of toner particles with each other is increased by stirring) causes tendency of burying of an external additive to the toner particle surfaces and/or defects of being liberated (detached) from the toner particle surfaces. It becomes difficult to impart a stable charging ability (charge stability) to the toner particles over time. Thus, there is a need for development of a toner in which the above problems are solved.

Patent Literature 1 discloses an electrophotographic developer comprising a toner containing at least a binder resin, a colorant, a release agent and inorganic particles, wherein titania (inorganic particles) is contained as an external additive, and there is a peak in an absolute value of charge amount of 20 to 40 μC/g, and a total of the distribution function values (14 μC/g or less) is 0.8 mg/10 g in a distribution correlation diagram of the charge amount which is measured by a blowoff method.

Incidentally, a toner is charged by contact with charge members such as a carrier and a blade, and the charge amount of each of the toner particles varies. The variations in toner charge amount causes variations in development property. Further, a toner with little charge amount and a toner oppositely charged are developed to a non-image area and cause not only fogging and waste of toner but also toner scattering, and further produce detects such as image soiling and contamination of inside of the development device. In order to resolve such problems, it is preferable that the toner charge amount less varies. Also, a toner whose charge amount is specified is suggested.

For example, Patent Literature 2 discloses a developing method that uses a non-magnetic one-component toner containing at least a binder resin, a colorant and a charge control agent and having a surface coated with an external additive, wherein a peak of (Q/D) in distribution (Q/D) which is expressed by charge amount (Q) and toner particle diameter (D), the percentage of the number of particles within a specific range, and the percentage of the number of oppositely charged particles are adjusted to a specific range. Patent Literature 3 discloses a developing method comprising the steps of: supplying a toner comprising base particles and an external additive from a toner supply unit to a developer stirring unit; mixing the supplied toner with a developer by an stirring member; charging the toner to be carried and feed onto a developer carrying support; and visualizing an electrostatic latent image formed on an latent image carrying support, wherein the amount of weakly and/or oppositely charged toner components in the charged toner amount distribution at an inlet of the developer stirring unit immediately after supplying the toner, and the amount of weakly and/or oppositely charged toner components in the charged toner amount distribution at an outlet of the developer stirring unit immediately before the toner passes through the developer stirring unit and is carried onto the developer carrying support are satisfy a specific relationship.

Patent Literature 4 discloses a toner comprising at least a binder resin, a colorant and a wax, wherein when the charged particle amount distribution is measured by the laser Doppler method, the proportion of the particles having a dwell-time of 3.0 to 10.0 ms is in a range of 40 to 90% based on all the toner particles, an absolute value of a peak top of main peaks in distribution (q/d) which is expressed by charge amount (q) and toner particle diameter is within a specific range, and the half width of the main peaks in distribution (q/d) is in a specific range.

However, Patent Literatures 2 to 4 disclose that the charge amount in the toner particles varies and the use of those toners allows for output of a stable image. The present inventors have examined and found that if the toners are superimposed and printed, the charging ability of the toners needs to be further controlled.

CITATION LIST

Patent Literature

Patent Literature 1: JP-A No. 2006-323368
Patent Literature 2: JP-A No. 2001-255691
Patent Literature 3: JP-A No. 2003-149850
Patent Literature 4: JP-A No. 2005-321589

SUMMARY OF INVENTION

Technical Problem

An object of the present invention is to solve the above problems and to provide a toner set that is excellent in fine line reproducibility and color reproducibility when toners are superimposed and printed.

Solution to Problem

The present inventors have found that it is possible to solve the above problems by using a toner set in which the charge amount and variations in charge amount measured by a charge amount distribution measurement device are within a specific range in all the cases of yellow, magenta and cyan toners, and a difference between charge amounts for each of the toners and a difference between variations in charge amount for each of the toners is less than or equal to a specific value.

That is, according to the present invention, there is provided a toner set comprising a yellow toner, a cyan toner and a magenta toner, the toners each comprising an external additive and colored resin particles comprising a binder resin, a colorant and a charge control agent, wherein an absolute value of an average of q/d for any of the yellow, cyan and magenta toners which is expressed by charge amount q (fC) and particle diameter d (μm) and which is obtained by measurement using an electric field detachment-type charge amount distribution measurement device after the following frictional charge treatment, is in a range of 2.0 to 6.5 fC/10 μm, and a standard deviation (SD) of q/d for any of the yellow, cyan and magenta toners is 13 fC/10 μm or less, and wherein a difference (Δq/d) between average values of q/d for any two of the yellow, cyan and magenta toners is 2.0 fC/10 μm or less, and a difference (ΔSD) between standard deviations of q/d for the two toners is 5.0 fC/10 μm or less.

[Frictional Charge Treatment]

First, 9.5 g of a non-coated Mn—Mg—Sr based ferrite carrier and 0.5 g of a toner to be measured are put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%.

In the present invention, the yellow toner, the cyan toner and the magenta toner are negatively-chargeable toners.

In the present invention, with respect to 100 parts by mass of the colored resin particles, the external additive comprises 0.1 to 1 part by mass of fine silica particles A having a number average primary particle diameter of 5 to 25 nm and 0.3 to 2 parts by mass of fine silica particles B having a number average primary particle diameter of 30 to 90 nm.

In the present invention, with respect to 100 parts by mass of the colored resin particles, the external additive further comprises 0.1 to 1 part by mass of fine titanium oxide particles having a number average primary particle diameter of 10 to 90 nm.

In the present invention, with respect to 100 parts by mass of the colored resin particles, the external additive further comprises 0.1 to 1.5 parts by mass of fine zinc oxide particles having an average long diameter of 50 to 2,000 nm.

Advantageous Effects of Invention

According to the present invention as described above, any of the three toners of the toner set has a specific absolute value of an average of q/d and a specific standard deviation (SD) of q/d, and the maximum value of a difference (Δq/d) between average values of q/d for any two of the three toners constituting the toner set and the maximum value of a difference (ΔSD) between standard deviations of q/d is in a specific range so that it is possible to provide a toner set excellent in fine line reproducibility and color stability.

DESCRIPTION OF EMBODIMENTS

The toner set of the present invention is a toner set comprising a yellow toner, a cyan toner and a magenta toner, the toners each comprising an external additive and colored resin particles comprising a binder resin, a colorant and a charge control agent, wherein an absolute value of an average of q/d for any of the yellow, cyan and magenta toners which is expressed by charge amount q (fC) and particle diameter d (μm) and which is obtained by measurement using an electric field detachment-type charge amount distribution measurement device after the following frictional charge treatment, is in a range of 2.0 to 6.5 fC/10 μm, and a standard deviation (SD) of q/d for any of the yellow, cyan and magenta toners is 13 fC/10 μm or less, and wherein a difference (Δq/d) between average values of q/d for any two of the yellow, cyan and magenta toners is 2.0 fC/10 μm or less, and a difference (ΔSD) between standard deviations of q/d for the two toners is 5.0 fC/10 μm or less.

[Frictional Charge Treatment]

First, 9.5 g of a non-coated Mn—Mg—Sr based ferrite carrier and 0.5 g of a toner to be measured are put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%.

Hereinafter, the toner set of the present invention will be described.

The toner set of the present invention includes three color toners which include a yellow toner, a cyan toner and a magenta toner. Any of the yellow, cyan and magenta toners contains an external additive and colored resin particles comprising a binder resin, a colorant and a charge control agent.

Hereinafter, a method for producing colored resin particles used in the present invention, the colored resin particles obtained by the production method, a method for producing a toner using the colored resin particles, and the toner obtained by the production method and a toner set with a combination of these toners according to the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, a charge control agent, and other additives such as a release agent, etc., which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds in which two or more carboxylic acids having a carbon-carbon double bond are esterified to alcohol having two or more hydroxyl groups such as ethylene glycol dimethacrylate and diethylene glycol dimethacrylate; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use macromonomer as part of the polymerizable monomer since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular weight of 1,000 to 30,000. A preferable macromonomer is one capable of providing a polymer having higher glass transition temperature (hereinafter may be referred to as "Tg") than a polymer obtained by the polymerization of the monovinyl monomer. The macromonomer to be used is preferably in the range from 0.03 to 5 parts by mass, more preferably from 0.05 to 1 part by mass, with respect to 100 parts by mass of the monovinyl monomer.

Examples of the yellow colorant to be used for the yellow toner include azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used for the magenta toner include azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

Examples of the cyan colorant to be used for the cyan toner include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

In the present invention, these colorants can be used alone or in combination of two or more kinds. The amount of the colorant is preferably in the range from 1 to 10 parts by mass with respect to 100 parts by mass of the monovinyl monomer.

In the present invention, in order to improve the charging ability of the toner, a charge control agent is used. The charge control agent is not particularly limited as long as it is generally used as a charge control agent for toner. Among charge control agents, a charge control agent having negatively charging ability is preferred since the charge control agent is highly compatible with the polymerizable monomer and can impart a high charging ability to the toner particles. From the viewpoint of obtaining a negatively-chargeable toner, the charge control resin having negatively charging ability is more preferably used.

Examples of the charge control agent having negatively charging ability include azo dyes containing metals such as Cr, Co, Al and Fe, salicylic acid compounds such as salicylic acid metal compounds and alkyl salicylic acid metal compounds as well as charge control resins such as sulfonic acid group-containing copolymers, sulfonate group-containing copolymers, carboxylic acid group-containing copolymers and carboxylic salt group-containing copolymers. Preferred are salicylic acid compounds such as salicylic acid metal compounds and alkyl salicylic acid metal compounds as well as sulfonic acid group-containing copolymers or sulfonate group-containing copolymers.

In the present invention, it is preferable to use a charge control resin as a charge control agent. It is more preferable to use a sulfonic acid group-containing copolymer obtained by copolymerizing vinyl aromatic hydrocarbon, (meth)acrylate and sulfonic acid group-containing (meth)acrylamide. The sulfonic acid group-containing copolymer is colorless enough to obtain a color toner. The sulfonic acid group-containing (meth)acrylamide is copolymerized, whereby a sulfonic acid group is contained in the copolymer. Thus, the sulfonic acid group-containing copolymer can be used as the charge control agent having negatively charging ability. The copolymerization ratio of the sulfonic acid group-containing (meth)acrylamide in the sulfonic acid group-containing copolymer is necessary to be in a range of 0.5 to 10% by mass, preferably in a range of 1.0 to 10% by mass, further preferably in a range of 1.5 to 9% by mass. When the copolymerization ratio of the sulfonic acid group-containing (meth)acrylamide is less than 0.5% by mass, the effect of imparting a negative charging ability is low. In contrast with this, when the copolymerization ratio exceeds 15% by mass, the environmental stability of the toner deteriorates.

Incidentally, the term "sulfonic acid group" used herein includes its salt (sulfonate group).

The copolymerization ratio (% by mass) of the sulfonic acid group-containing (meth)acrylamide in the sulfonic acid group-containing copolymer can be obtained, for example, by measuring the sulfur content by elemental analysis such as X-ray fluorescence (XRF) and calculating from the result. Further, in the case of synthesizing the sulfonic acid group-containing copolymer, a value obtained by subtracting the mass of the sulfonic acid group-containing (meth)acrylamide from the total mass of the vinyl aromatic hydrocarbon, the (meth) acrylate, and the sulfonic acid group-containing (meth)acrylamide may be used as the copolymerization ratio of the sulfonic acid group-containing (meth)acrylamide in the sulfonic acid group-containing copolymer (% by mass).

The copolymerization of the vinyl aromatic hydrocarbon enables a stable sulfonic acid group-containing copolymer to be obtained. The adjustment of the copolymerization ratio between the vinyl aromatic hydrocarbon and the (meth) acrylate enables the glass transition temperature (Tg) of the sulfonic acid group-containing copolymer to be controlled to a desired range, whereby the fixing temperature can be made relatively low without impairing heat-resistant shelf stability. Further, the use of the vinyl aromatic hydrocarbon in combination with the (meth) acrylate enables the compatibility of the sulfonic acid group-containing copolymer with the toner polymer component to be improved, whereby a toner having uniform charging ability and uniform characteristics can be formed. The copolymerization ratio (mass basis) of the vinyl aromatic hydrocarbon and the (meth) acrylate is usually from 99:1 to 50:50, preferably from 95:5 to 70:30.

The weight average molecular weight (Mw) of the sulfonic acid group-containing copolymer used in the present invention is necessary to be in a range of 5,000 to 30,000, preferably in a range of 8,000 to 25,000, more preferably in a range of 10,000 to 20,000 in terms of the polystyrene equivalent measured by gel permeation chromatography (GPC) using tetrahydrofuran. If the weight average molecular weight of the sulfonic acid group-containing copolymer is too large, the size of the droplets of the polymerizable monomer composition becomes nonuniform during polymerization and it is difficult to obtain a toner having a uniform particle diameter. Eventually, the fluidity and heat-resistant shelf stability tend to be reduced, the environment dependency and durability of image quality are also worsened, and further it becomes difficult to decrease the fixing temperature. If the weight average molecular weight of the sulfonic acid group-containing copolymer is too small, the fluidity of the toner to be obtained becomes insufficient, the heat-resistant shelf stability is also reduced, and further the environment dependency and durability of image quality tend to be worsened. Hereinafter, starting materials of the sulfonic acid group-containing copolymer used in the present invention and a production method thereof will be described in detail.

The vinyl aromatic hydrocarbon used to produce the sulfonic acid group-containing copolymer is a compound (monomer) having a structure in which a vinyl group is bound to an aromatic hydrocarbon. Specific examples thereof include styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chloro styrene, 3-chloro styrene, 4-chloro styrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethylstyrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethyl-α-methylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methylstyrene, 2-methyl-4-propyl-α-methylstyrene and 2-chloro-4-ethyl-α-methylstyrene. These vinyl aromatic hydrocarbons may be used alone or in combination of two or more kinds.

The (meth) acrylate used to produce the sulfonic acid group-containing copolymer is an acrylic acid ester or methacrylic acid ester. Specific examples thereof include compounds such as acrylic acid esters such as methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate and lauryl acrylate; and methacrylic acid esters such as methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate. These (meth) acrylates may be used alone or in combination of two or more kinds.

Examples of the sulfonic acid group-containing (meth) acrylamide used to produce the sulfonic acid group-containing copolymer include 2-acrylamide-2-methylpropanesulfonic acid, 2-acrylamide-n-butanesulfonic acid, 2-acrylamide-n-hexanesulfonic acid, 2-acrylamide-n-octanesulfonic acid, 2-acrylamide-n-dodecanesulfonic acid, 2-acrylamide-n-tetradecanesulfonic acid, 2-acrylamide-2-methylpropanesulfonic acid, 2-acrylamide-2-phenylpropanesulfonic acid, 2-acrylamide-2,2,4-trimethyl pentanesulfonic acid, 2-acrylamide-2-methylphenyl ethane sulfonic acid, 2-acrylamide-2-(4-chlorophenyl)propanesulfonic acid, 2-acrylamide-2-carboxymethyl propanesulfonic acid, 2-acrylamide-2-(2-pyridine)propanesulfonic acid, 2-acrylamide-1-methylpropanesulfonic acid, 3-acrylamide-3-methylbutanesulfonic acid, 2-methacrylamide-n-decanesulfonic acid and 4-methacrylamide benzenesulfonic acid. These sulfonic acid group-containing (meth)acrylamides may be used alone or in combination of two or more kinds.

The sulfonic acid group-containing copolymer used in the present invention can be obtained by copolymerizing monomer components by an optional method such as an emulsion polymerization method, a dispersion polymerization method, a suspension polymerization method and a solution polymerization method. Among these polymerization methods, the solution polymerization method is preferred from the viewpoint of easily adjusting the copolymerization ratio and the weight average molecular weight. Examples of the polymerization initiator used to produce the sulfonic acid group-containing copolymer include azo compounds such as 2,2'-azobisisobutyronitrile, 2,2'-azobis(2,4-dimethylvaleronitrile), 2,2'-azobis(4-methoxy-2,4-dimethylvaleronitrile), 2,2'-azobisisobutyrate, 4,4'-azobis(4-cyano pentanoic acid), 4,4'-azobis(4-cyano valeric acid), 2,2'-azobis(2-amidinopropane)dibasic acid, 2,2-azobis-2-methyl-N-1,1-bis(hydroxymethyl)-2-hydroxydiethylpropionamide and 1,1'-azobis(1-cyclohexanecarbonitrile); diamine compounds such as 2,2'-azobis(2-amidinopropane)dihydrochloride, 2,2'-azobis(N,N'-dimethyleneisobutylamidine), 2,2'-azobis(N,N'-dimethyleneisobutylamidine)dihydrochloride; and peroxides such as methylethyl peroxide, di-t-butyl peroxide, acetyl peroxide, dicumyl peroxide, lauroyl peroxide, benzoyl peroxide, t-butylperoxy-2-ethylhexanoate, di-isopropyl peroxidicarbonate and di-t-butyl peroxyisophthalate.

The amount of the polymerization initiator to be used may be optionally selected according to the target weight average molecular weight, and is usually from 0.01 to 10 parts by mass, preferably from 0.1 to 5 parts by mass with respect to the total amount of 100 parts by mass of the monomer. In the solution polymerization, an anionic polymerization initiator such as a reaction product of alkali metal, butyl lithium, alkali metal and naphthalene may also be used.

The solvent and dispersant used in the solution polymerization may be selected, as appropriate. Specific examples of hydrocarbon compounds include aromatic hydrocarbon compounds, such as benzene, toluene and xylene; and saturated hydrocarbon organic compounds, such as n-hexane, cyclohexane, methylcyclohexane, ethylcyclohexane, nonane, decane, decalin and dodecane. Examples of oxygen-containing organic compounds include hydroxyl group-containing compounds such as methanol, ethanol, n-propyl alcohol, isopropyl alcohol, n-butyl alcohol, isobutyl alcohol, secondary butyl alcohol, amyl alcohol, isoamyl alcohol, methyl isobutyl carbinol, 2-ethylbutanol, 2-ethylhexanol, cyclohexanol, furfuryl alcohol, tetrahydrofurfuryl alcohol, ethylene glycol, hexylene glycol, glycerin; aliphatic saturated ethers such as propyl ether, isopropyl ether, butyl ether, isobutyl ether, n-amyl ether, isoamyl ether, methylbutyl ether, methylisobutyl ether, methyl n-amyl ether, methylisoamyl ether, ethylpropyl ether, ethylisopropyl ether, ethylbutyl ether, ethylisobutyl ether, ethyl n-amyl ether and ethyl isoamyl ether; aliphatic unsaturated ethers such as allyl ether and ethyl allyl ether; aromatic ethers such as anisole, phenetole, phenyl ether and benzyl ether; cyclic ethers such as tetrahydrofuran, tetrahydropyran and dioxane; ethylene glycols such as ethylene glycol monomethyl ether, ethylene glycol monoethyl ether, ethylene glycol monobutyl ether, diethylene glycol monomethyl ether, diethylene glycol monoethyl ether and diethylene glycol monobutyl ether; and organic acids such as formic acid, acetic acid, acetic anhydride and butyric acid; organic acid esters such as butyl formate, amyl formate, propyl acetate, isopropyl acetate, butyl acetate, secondary butyl acetate, amyl acetate, isoamyl acetate, 2-ethylhexyl acetate, cyclohexyl acetate, butylcyclohexyl acetate, ethyl propionate, butyl propionate, amyl propionate, butyl butyrate, diethyl carbonate, diethyl oxalate, methyl lactate, ethyl lactate, butyl lactate and triethyl phosphate; ketones such as methyl isopropyl ketone, methyl isobutyl ketone, ethyl isobutyl ketone, diisobutyl ketone, acetylacetone, diacetone alcohol, cyclohexanone, cyclopentanone, methylcyclohexanone and cycloheptanone; and other oxygen-containing organic compounds such as 1,4-dioxane, isophorone and furfural.

The polymerization temperature and polymerization time may be optionally selected according to the polymerization method and the kind of polymerization initiator to be used. Usually, the polymerization temperature is about from 50 to 200° C., and the polymerization time is about from 0.5 to 20 hours. In the polymerization, usually known additives such as polymerization assisting agents (e.g., amine) may also be used together. As a method for recovering a sulfonic acid group-containing copolymer from a system after polymerization, usable are, for example, a method for precipitating a copolymer by adding a poor solvent, a method for recovering a solvent by steam, a method for removing a solvent by reduced pressure, a method for removing a solvent by heat melting, a method for freeze-drying, and a method for performing a high-concentration polymerization and directly adding to a polymerized toner system.

The content of the charge control agent is usually from 0.1 to 8 parts by mass, preferably from 0.2 to 5 parts by mass, preferably from 0.3 to 3 parts by mass with respect to 100 parts by mass of the polymerizable monomer (suitably a monovinyl monomer). If the content of the charge control agent is less than 0.1 part by mass, the charge amount becomes insufficient and thus fogging may occur. If the content exceeds 8 parts by mass, fogging may occur in a low temperature and low humidity environment.

In the present invention, it is preferable to concurrently use two different kinds of charge control agents together therewith, and it is more preferable to concurrently use two different kinds of charge control resins. If the two different kinds of charge control resins are used concurrently, it is preferable to use a charge control resin having a functional group amount (e.g., copolymerization ratio of sulfonic acid group-containing (meth)acrylamide in a sulfonic acid group-containing copolymer) of 0.5 to 4% by mass in combination with 5 to 15% by mass of a charge control resin.

From the viewpoint of improving the releasing characteristics of the toner from a fixing roller at fixing, the release agent is added to the polymerizable monomer composition as another additive. The release agent can be used without any particular limitation as long as it is generally used as a release agent for the toner. The release agent preferably contains at least one of an ester wax or hydrocarbon wax. The use of these waxes as the release agents allows the balance between low-temperature fixability and shelf stability to be improved.

The ester wax suitably used as the release agent in the present invention is more preferably a polyfunctional ester wax. Examples thereof include pentaerythritol ester compounds such as pentaerythritol tetrapalmitate, pentaerythritol tetrabehenate, pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerintribehenate; and dipentaerythritol ester compounds such as dipentaerythritol hexamyristate and dipentaerythritol hexapalmitate. Among them, preferred is a dipentaerythritol ester compound. More preferred is dipentaerythritol hexamyristate.

In addition to the release agents, natural waxes such as jojoba wax; and mineral waxes such as ozokerite can be used. The release agent may be used in combination with one or two or more kinds of the waxes.

The amount of the release agent to be used is preferably in the range from 0.1 to 30 parts by mass, more preferably from 1 to 20 parts by mass, with respect to 100 parts by mass of the monovinyl monomer.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition comprising at least a polymerizable monomer, a colorant and a charge control agent is dispersed in an aqueous medium containing a dispersion stabilizer, and a polymerization initiator is added therein. Then, the droplets of the polymerizable monomer composition are formed. The method for forming droplets is not particularly limited. The droplets are formed by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the toner to be obtained; moreover, environmental stability can be excellent.

(A-3) Polymerization Process

After the droplets are formed as described in the above (A-2), thus obtained aqueous dispersion medium is heated to polymerize. Thereby, an aqueous dispersion of colored resin particles is formed.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particle may be used as a toner obtained by adding an external additive. It is preferable that the colored resin particle is so-called core-shell type (or "capsule type") colored resin particle which is obtained by using the colored resin particle as a core layer and forming a shell layer, a material of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium to which the colored resin particles are dispersed followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl) propionamide). These polymerization initiators can be used alone or in combination of two or more kinds. The amount of the polymerization initiator is preferably in the range from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that acid or alkali is added to the aqueous dispersion of colored resin particles; thereby, the dispersion stabilizer is dissolved in water and removed. If colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the following processes are performed.

First, a binder resin, a colorant, a softening agent and other additives such as a charge control agent, etc., which are added if required, are mixed by means of a mixer such as a ball mill, a V type mixer, FM MIXER (product name; manufactured by NIPPON COKE & ENGINEERING CO., LTD.), a high-speed dissolver or an internal mixer. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the charge control agent and other additives such as the release agent, etc., which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably in the range from 5.8 to 7.5 μm, more preferably from 6.0 to 7.2 μm, still more preferably from 6.2 to 6.8 μm. If the volume average particle diameter (Dv) of the colored resin particles is less than 5.8 μm, the flowability of the polymerized toner may lower, the transferability may deteriorate, and the image density may decrease. If the volume average particle diameter (Dv) of the colored resin particles exceeds 7.5 μm, the resolution of images may decrease.

As for the colored resin particles, a ratio (particle size distribution (Dv/Dn)) of the volume average particle diameter (Dv) and the number average particle diameter (Dn) is preferably in the range from 1.00 to 1.20, more preferably from 1.00 to 1.18, still more preferably from 1.00 to 1.15 μm. If "Dv/Dn" exceeds 1.20, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles of the present invention is preferably in the range from 0.96 to 1.00, more preferably from 0.97 to 1.00, even more preferably from 0.98 to 1.00, from the viewpoint of image reproducibility.

If the average circularity of the colored resin particles is less than 0.96, the reproducibility of thin lines may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

3. Method for Producing Toner

The above colored resin particles are mixed and stirred with an external additive, whereby the external additive is uniformly and suitably attached and added (externally added) onto the surface of the colored resin particles. Incidentally, a one-component toner may be mixed and stirred with carrier particles and the resultant mixture may be used as a two-component toner.

The agitator for adding an external additive to colored resin particles is not particularly limited as long as it is an agitator capable of attaching the external additive on the surface of the colored resin particles. The examples include agitators capable of mixing and agitating, such as FM MIXER (product name; manufactured by NIPPON COKE & ENGINEERING CO., LTD.), SUPER MIXER (product name; manufactured by KAWATA Manufacturing Co., Ltd.), Q MIXER (product name; manufactured by NIPPON COKE & ENGINEERING CO., LTD.), MECHANOFUSION SYSTEM (product name; manufactured by Hosokawa Micron Corporation) and MECHANOMILL (product name; manufactured by Okada Seiko Co., Ltd.).

It is preferable to use the external additive in combination with fine silica particles A having a relatively small number average primary particle diameter (5 to 25 nm) and fine silica particles B having a relatively large number average primary particle diameter (30 to 90 nm), and it is further preferable to use fine titanium oxide particles or fine zinc oxide particles.

The fine silica particles A have preferably a number average primary particle diameter of 5 to 25 nm, more preferably a number average primary particle diameter of 6 to 20 nm, further more preferably a number average primary particle diameter of 7 to 16 nm.

If the number average primary particle diameter of the fine silica particles A is less than 5 nm, the fine silica particles A are easily buried from the surface of the colored resin particles to the inside. If the number of printed sheets is large, it is not possible to sufficiently impart fluidity to the toner particles. This may cause adverse effects on the printing performance. On the other hand, if the number average primary particle diameter of the fine silica particles A exceeds 25 nm, the proportion (coverage) of the fine silica particles A to the toner particle surfaces is reduced. Thus, it is not possible to sufficiently impart fluidity to the toner particles.

The fine silica particles B have preferably a number average primary particle diameter of 30 to 90 nm, more preferably a number average primary particle diameter of 40 to 80 nm, further more preferably a number average primary particle diameter of 45 to 60 nm.

If the number average primary particle diameter of the fine silica particles B is less than 30 nm, the spacer effect is reduced, the fine silica particles A are easily buried from the surface of the colored resin particles to the inside, which may cause adverse effects on the printing performance such as occurrence of fogging. On the other hand, if the number average primary particle diameter of the fine silica particles B exceeds 90 nm, the fine silica particles B are easily liberated from the surface of toner particles and the function as the external additive is reduced, which may cause adverse effects on the printing performance.

The number average primary particle diameter of the external additive used in the present invention can be measured, for example, in the following manner.

First, particle diameter of each particle of the external additive is measured using, for example, a transmission electron microscope (TEM) or a scanning electron microscope (SEM). Thus, particle diameters of 30 or more of external additive particles are measured, and an average of the measured diameters is defined as a number average primary particle diameter of the particles.

Another example of the method for measuring the number average primary particle diameter of the external additive used in the present invention includes a method for measuring a number average primary particle diameter comprising the steps of: dispersing external additive particles in a disperse medium such as water; and measuring the dispersion using such as a particle size distribution measurement device (product name: MICRO TRACK 3300EXII, manufactured by Nikkiso Co., Ltd.).

Usable fine silica particles A include various types of commercially available products. Examples thereof include products manufactured by Nippon Aerosil Co., Ltd. such as RX300 (product name, with a number average primary particle diameter of 7 nm), RX200 (product name, with a number average primary particle diameter of 12 nm), R202 (product name, with a number average primary particle diameter of 14 nm) and R972 (product name, with a number average primary particle diameter of 16 nm); and products manufactured by Clariant such as HDK H13TD (product name, with a number average primary particle diameter of 20 nm), H13TX (product name, with a number average primary particle diameter of 20 nm) and H20TX (product name, with a number average primary particle diameter of 12 nm); a product manufactured by Cabot such as TG-7120 (product name, with a number average primary particle diameter of 20 nm); and products manufactured by TAYCA Corporation such as MSN-002 (product name, with a number average primary particle diameter of 16 nm), MSP-012 (product name, with a number average primary particle diameter of 16 nm) and MSP-013 (product name, with a number average primary particle diameter of 12 nm).

Usable fine silica particles B include various types of commercially available products. Examples thereof include products manufactured by Nippon Aerosil Co., Ltd. such as NY50 (product name, with a number average primary particle diameter of 30 nm) and RX50 (product name, with a number average primary particle diameter of 40 nm); products manufactured by Clariant such as HDK H05TD (product name, with a number average primary particle diameter of 50 nm), H05TM (product name, with a number average primary particle diameter of 50 nm) and HDK H05TX (product name, with a number average primary particle diameter of 50 nm); and a product manufactured by Cabot such as TG-C321 (product name, with a number average primary particle diameter of 70 nm).

In the present invention, in the case of combine use of external additives having different particle diameters (e.g., combine use of fine silica particles A and B), an external addition treatment may be carried out by putting the colored resin particles and the external additives into a stirrer at one time, and mixing and stirring the mixture. Further, the external addition treatment may be carried out by firstly putting colored resin particles and an external additive having a large particle diameter (e.g., fine silica particles B) into a stirrer, mixing and stirring the mixture, then putting an external additive having a smaller particle diameter (e.g., fine silica particles A) into a stirrer, and mixing and stirring the mixture.

The content of the fine silica particles A is preferably from 0.1 to 1 part by mass, preferably from 0.2 to 0.9 parts by mass, more preferably from 0.3 to 0.7 parts by mass with respect to 100 parts by mass of the colored resin particles. If the content of the fine silica particles A is less than the above range, the image reproducibility may be reduced. On the other hand, if the content of the fine silica particles A exceeds the above range, fog may occur.

The content of the fine silica particles B is preferably from 0.3 to 2 parts by mass, more preferably from 0.4 to 1.8 parts by mass, more preferably from 0.5 to 1.4 parts by mass with respect to 100 parts by mass of the colored resin particles. If the content of the fine silica particles B is outside the above range, the printing durability may be reduced.

In the present invention, the total added amount of the external additive is preferably from 0.1 to 6.0 parts by mass, more preferably from 0.2 to 5.0 parts by mass, further preferably from 0.5 to 4.0 parts by mass with respect to 100 parts by mass of the colored resin particles. If the total added amount of the external additive is outside the above range, the printing durability may be reduced or the image reproducibility may be reduced.

It is preferable that both the fine silica particles A and B are surface treated with a hydrophobizing agent having a negatively charged functional group. In the surface treatment of the two fine silica particles, a general hydrophobizing agent may also be used in order to adjust hydrophobicity and/or negatively charging ability. The two fine silica particles are preferably subjected to hydrophobizing treatment with a silicon compound, and more preferably subjected to hydrophobizing treatment with two or more kinds of silicon compounds.

As the amino group-containing silicon compound which is used as a hydrophobizing agent to adjust the balance of charging ability to positive, for example, an amino group-containing silane coupling agent, an amino modified silicone oil, a quaternary ammonium salt type silane and a cyclic silazane may be used. Among them, the amino group-containing silane coupling agent is particularly preferred from the viewpoint of positive charge imparting ability and fluidity. Specific examples of the amino group-containing silane coupling agent include N-2-(aminoethyl)-3-aminopropyl methyl dimethoxysilane, N-2-(aminoethyl)-3-aminopropyl trimethoxysilane, 3-aminopropyl trimethoxysilane, 3-aminopropyl triethoxysilane and N-phenyl-3-aminopropyl triethoxysilane. Among them, the amino alkyl group-containing silane coupling agent is preferred because the improvement effect of the environmental stability of the charging performance is excellent.

From the viewpoint of the environmental stability of charging performance and the fluidity of the toner to be obtained, as the silicon compound containing no amino group, for example, an alkoxysilane, a silane coupling agent, a silazane, a silicone oil and a silicone resin are preferred. Particularly, the alkoxysilane, silicone oil, and silicone resin are preferred. Examples of the alkoxysilane include isobutyltrimethoxysilane, octyl triethoxysilane and trifluoropropyl trimetoxysilane. Examples of the silicone oil include straight silicone oils such as dimethylpolysiloxane and methyl hydrogen polysiloxane; and modified silicone oils such as epoxy-modified silicone oil and fluorine-modified silicone oil. Examples of the silicone resin include trimethylsiloxy silicic acid.

In the present invention, a general method may be used to subject an external additive to hydrophobizing treatment and examples thereof include a dry method and a wet method. Specific examples thereof include a method comprising a step of adding dropwise or spraying the hydrophobizing agent while stirring an external additive at high speed and a method comprising the steps of: dissolving the hydrophobizing agent in an organic solvent, and adding an external additive while stirring the organic solvent containing the hydrophobizing agent. In the former case, the hydrophobizing agent may be diluted with, for example, an organic solvent.

In the present invention, it is preferable that the fine silica particles A and B having a specific particle diameter range as described above may be used together as external additives. If necessary, another external additive may be added thereto. Examples thereof include inorganic particles such as titanium oxide, aluminium oxide, zinc oxide, tin oxide, calcium carbonate, calcium phosphate and cerium oxide; a methacrylic acid ester polymer, acrylic acid ester polymer, styrene-methacrylic acid ester copolymer, styrene acrylic acid ester copolymer and melamine resin; and organic resin particles such as core shell particles in which the core is formed of a styrene polymer and the shell is formed of a methacrylic acid ester polymer.

In order to obtain the toner of the present invention, 0.1 to 1 part by mass of fine titanium oxide particles having a number average primary particle diameter of 10 to 90 nm with respect to 100 parts by mass of the colored resin particles are preferably contained as the external additive.

If the number average primary particle diameter of the fine titanium oxide particles is less than 10 nm, filming onto the photoconductor is generated during durable printing. Thus, the printing performance may be reduced. If the number average primary particle diameter of the fine titanium oxide particles exceeds 90 nm, it may be difficult to obtain the fine line reproducibility and color reproducibility, which are the effects of the present application.

If the content of the fine titanium oxide particles is less than 0.1 parts by mass with respect to 100 parts by mass of the colored resin particles, it may be difficult to obtain the fine line reproducibility and color reproducibility, which are the effects of the present application. Further, if the content of the fine titanium oxide particles exceeds 1 part by mass with respect to 100 parts by mass of the colored resin particles, filming onto the photoconductor is generated during durable printing. Thus, the printing performance may be reduced.

Various types of commercially available products may be used as the fine titanium oxide particles. Examples thereof include T805 (product name, manufactured by Nippon Aerosil Co., Ltd., number average primary particle diameter: 50 nm) and $TiO_2$-SDS (product name, manufactured by Fuji Pigment Co., Ltd., number average primary particle diameter: 15 nm).

In order to obtain the toner of the present invention, it is preferable to use fine zinc oxide particles having an average long diameter of 50 to 2,000 nm as the external additive. The average long diameter of the fine zinc oxide particles is preferably from 80 to 1,200 nm, more preferably from 200 to 800 nm. The fine zinc oxide particles preferably have a plate shape.

The added amount of the fine zinc oxide particles is preferably from 0.1 to 1.5 parts by mass, more preferably from 0.2 to 1.2 parts by mass, even more preferably from 0.3 to 1.0 parts by mass, with respect to 100 parts by mass of the colored resin particles. If the added amount of the fine zinc oxide particles is less than 0.1 part by mass, the effect of adding the fine zinc oxide particles is not sufficiently obtained. This may increase a difference between early-stage conveyance amount and durable conveyance amount. On the other hand, if the content of fine zinc oxide particles exceeds 1.5 parts by mass, the low-temperature fixability may be poor. Various types of commercially available products may be used as the fine zinc oxide particles.

Examples thereof include products manufactured by Sakai Chemical Industry Co., Ltd., such as XZ-500F (product name, with a hexagonal plate shape and an average long diameter of 450 nm), XZ-300F (product name, with a hexagonal plate shape and average long diameter of 350 nm), and XZ-100F (product name, with a hexagonal plate shape and an average long diameter of 140 nm).

4. Toner Constituting Present Invention and Toner Set of Present Invention

In the toner set of the present invention, an average of q/d for any of the toners which is expressed by charge amount q (fC) and particle diameter d (μm) and which is obtained by measurement using an electric field detachment-type charge amount distribution measurement device after the following frictional charge treatment and a standard deviation (SD) of q/d for any of the toners satisfy the following conditions (a) to (d).

[Frictional Charge Treatment]

First, 9.5 g of a non-coated Mn—Mg—Sr based ferrite carrier and 0.5 g of a toner to be measured are put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%.

Among them, the conditions (a) and (b) are conditions which should be satisfied by the toners constituting the present invention, and the conditions (c) and (d) are conditions which should be satisfied by the whole toner set.

(a) an absolute value of an average of q/d for any of the toners is from 2.0 to 6.5 fC/10 μm;

(b) a standard deviation (SD) of q/d for any of the toners is 13 fC/10 μm or less;

(c) a difference (Δq/d) between average values of q/d for any two of the toners is 2.0 fC/10 μm or less; and (d) a difference (ΔSD) between standard deviations of q/d for the two toners is 5.0 fC/10 μm or less.

The q/d for any of the toners which is expressed by charge amount q (fC) and particle diameter d (μm) and the standard deviation (SD) of q/d are values obtained by measurement using an electric field detachment-type charge amount distribution measurement device. Here, the term "electric field detachment-type" means a method including the steps of separating charged toners, allowing the separated toners to fly between electrodes having a constant potential difference, and measuring the charge amount in a position where the toner is attached to each electrode. A charge amount distribution measurement device according to the method is disclosed, for example, in JP-A No. 2009-150948. A typical example of the analyzer includes Q-TEST (product name, manufactured by Epping PES-Laboratorium). Hereinafter, an example of charge amount distribution measurement will be described. First, 9.5 g of a non-coated Mn—Mg—Sr based ferrite carrier and 0.5 g of a toner sample to be measured are put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%. Subsequently, the frictionally charged mixture and the charge amount distribution measurement device are used to measure q/d for any of the toners and a standard deviation (SD) of q/d for each of the toners under the following measurement conditions:

Airflow: 160 mL/min

Applied voltage: 4,000 V

First, the condition (a) will be described. If an absolute value of an average of q/d for any of the toners is less than 2.0 fC/10 μm, the charging level is low. Thus, image quality degradation, such as fog, occurs. If the absolute value of an average of q/d for each of the toners exceeds 6.5 fC/10 μm, the charging level is high. Thus, a poor image quality, such as printing soiling, occurs.

The absolute value of an average of q/d for each of the toners is preferably 2.2 fC/10 μm or more, more preferably 2.4 fC/10 μm or more. Further, the absolute value of an average of q/d for each of the toners is preferably 6.3 fC/10 μm or less, more preferably 6.2 fC/10 μm or less.

Subsequently, the condition (b) will be described. If the standard deviation (SD) of q/d for each of the toners exceeds 13 fC/10 μm, the environmental stability in a high temperature and high humidity environment is decreased, or the printing characteristics in multicolor printing are reduced.

Incidentally, the standard deviation (SD) of q/d for each of the toners may be 1 fC/10 μm or more.

The standard deviation (SD) of q/d for each of the toners is preferably 10 fC/10 μm or less, more preferably 5 fC/10 μm or less.

Subsequently, the condition (c) will be described. The term "difference (Δq/d) between average values of q/d for any two of the yellow, cyan and magenta toners is 2.0 fC/10 μm or less means that:

(c1) a difference (Δq/d) between average values of q/d for yellow and cyan toners (c2) a difference (Δq/d) between average values of q/d for yellow and magenta toners and, (c3) a difference (Δq/d) between average values of q/d for cyan and magenta toners are 2.0 fC/10 μm or less.

Hence, the condition (c) requires that all the different toners have the same level of charging ability. If at least one difference (Δq/d) between average values of q/d according to any of (c1) to (c3) exceeds 2.0 fC/10 μm, the color stability is reduced during durable printing.

Incidentally, the difference (Δq/d) of an average of q/d according to any of (c1) to (c3) is preferably 1.5 fC/10 μm or less, more preferably 1.0 fC/10 μm or less.

Finally, the condition (d) will be described. The term "difference (ΔSD) between standard deviations of q/d for the two toners is 5.0 fC/10 μm or less" means that:

(d1) a difference (ΔSD) between standard deviations of q/d for the yellow and cyan toners, (d2) a difference (ΔSD) between standard deviations of q/d between yellow and magenta toners, and (d3) a difference (ΔSD) between standard deviations of q/d for cyan and magenta toners are 5.0 fC/10 μm or less.

Hence, the condition (d) requires that the different toners have the same level of variation range of charging ability.

If at least one of the difference (ΔSD) between standard deviations of q/d according to any of (d1) to (d3) exceeds 5.0 fC/10 μm, the printing characteristics in multicolor printing are reduced.

Incidentally, the difference (ΔSD) between standard deviations of q/d according to any of (d1) to (d3) may be 0 fC/10 μm or more.

The difference (ΔSD) between standard deviations of q/d according to any of (d1) to (d3) is preferably 4.0 fC/10 μm or less, more preferably 3.0 fC/10 μm or less.

Since the yellow, cyan and magenta toners in the present invention easily produce the effects of the present invention, it is preferable that these toners are negatively-chargeable toners.

The absolute value of an average of q/d for each of the toners and the standard deviations of q/d for each of the toners can be controlled by adjusting the kind and amount of the charge control agent, the kind and amount of the external additive, the toner particle diameter and the toner particle size distribution.

In the toner set of the present invention, each of the three toners (YMC) has a specific charge amount and charge amount distribution and differences in charge amount and charge amount distribution among the three toners are small. Thus, the toner set has little color change and has excellent fine line reproducibility after duration in the mixed color printing.

EXAMPLES

Hereinafter, the present invention will be described further in detail with reference to examples and comparative examples. However, the scope of the present invention may not be limited to the following examples. Incidentally, "part(s)" and "%" are based on mass if not particularly mentioned.

Test methods used in the examples and the comparative examples are as follows.

1. Synthesis of Charge Control Resin

Synthesis Example 1

To a 3-L reactor, 900 parts of toluene, 72 parts of styrene, 26 parts of butyl acrylate, 2 parts of 2-acrylamide-2-methylpropanesulfonic acid, and 2 parts of 2,2'-azobis(2,4-dimethylvaleronitrile) were charged, and then a copolymerization reaction was performed at 90° C. for 8 hours while stirring the mixture. After the completion of the reaction, the solvent was removed by freeze-drying to obtain a sulfonic acid group-containing copolymer (charge control resin A) having a weight average molecular weight of 18,000 and a glass transition temperature of 58.2° C.

Synthesis Example 2

A sulfonic acid group-containing copolymer (charge control resin B) having a weight average molecular weight of 18,000 and a glass transition temperature of 57.8° C. was obtained in the same manner as in Synthetic example 1 except that 72 parts of styrene, 26 parts of butyl acrylate, 2 parts of 2-acrylamide-2-methylpropanesulfonic acid were changed to 68 parts of styrene, 24 parts of butyl acrylate, 8 parts of 2-acrylamide-2-methylpropanesulfonic acid in Synthetic example 1.

2. Production of Toner

2-1. Production of Yellow Toner

Production Example Y1

75 parts of styrene and 25 parts of n-butyl acrylate as polymerizable monomers and 7 parts of C.I. pigment yellow 155 as a yellow colorant were dispersed using a media agitation type disperser to obtain a polymerizable monomer mixture. To the polymerizable monomer mixture, 1.5 parts of the charge control resin A produced in Synthetic example 1, 0.7 part of the charge control resin B produced in Synthetic example 2, 5 parts of an ester wax (dipentaerythritol hexamyristate) as a release agent, 0.3 part of a polymethacrylic acid ester macromonomer (product name: AA6, manufactured by TOAGOSEI CO., LTD) as a macromonomer, 0.6 part of divinylbenzene as a crosslinkable polymerizable monomer, and 1.6 parts of t-dodecyl mercaptan as a molecular weight modifier were added. The mixture was mixed and dissolved to prepare a polymerizable monomer composition.

Separately, in an agitating chamber, an aqueous solution of 6.2 parts sodium hydroxide dissolved in 50 parts ion-exchanged water was gradually added to an aqueous solution of 10.2 parts magnesium chloride dissolved in 250 parts ion-exchanged water at room temperature while agitating to prepare a magnesium hydroxide colloid dispersion.

The polymerizable monomer composition was charged into the above-obtained magnesium hydroxide colloid dispersion and agitated at room temperature until the droplets were stable. 4.4 parts of t-butylperoxy-2-ethylbutanoate (product name: TRIGONOX 27, manufactured by Kayaku-AKZO-Corporation) as a polymerization initiator was added thereto. The dispersion containing the polymerization initiator was subjected to a high shear agitation at 15,000 rpm by means of an in-line type emulsifying and dispersing machine (product name: MILDER MDN303V; manufactured by Pacific Machinery & Engineering Co., Ltd). Thus, droplets of the polymerizable monomer composition were formed.

The suspension having the above-obtained droplets of the polymerization monomer composition dispersed (a polymerizable monomer composition dispersion) was charged into a reactor furnished with an agitating blade and the temperature thereof was raised to 90° C. to start a polymerization reaction. When the polymerization conversion reached almost 100%, 1.5 parts methyl methacrylate (a polymerizable monomer for shell) and 0.3 part 2,2'-azobis (2-methyl-N-(2-hydroxyethyl)-propionamide) (a polymerization initiator for shell; product name: VA-086; manufactured by Wako Pure Chemical Industries, Ltd.; water-soluble) dissolved in 20 parts ion-exchanged water were added in the reactor. After continuing the polymerization for another 4 hours at 90° C., the reactor was cooled by water to stop the reaction. Thus, an aqueous dispersion of colored resin particles was obtained.

To the aqueous dispersion of the colored resin particles obtained in the above manner, sulfuric acid was added dropwise while stirring the dispersion at room temperature, followed by acid washing until the pH reached 6.5 or less. Then, separation by filtration was performed, and thus a solid content was obtained. After 500 parts of ion-exchanged water was added to the solid content to make a slurry again, a water washing treatment (washing, filtration and dehydration) was performed several times. Next, separation by filtration was performed and the thus-obtained solid content was placed in a container of a dryer for drying at 40° C. for 24 hours. Thus, the resulting colored resin particles had a volume average particle diameter Dv of 6.8 μm, a particle size distribution Dv/Dn of 1.14 and an average degree of circularity of 0.981.

To 100 parts of the obtained colored resin particles, 0.4 part of fine silica particles a1 (product name: MSN-002, manufactured by TAYCA Corporation) having a number average primary particle diameter of 16 nm after being subjected to hydrophobizing treatment with silicone oil as fine silica particles A, 1.2 parts of fine silica particles b 1 (product name: HDK H05TD, manufactured by Clariant) having a number average primary particle diameter of 45 nm after being subjected to hydrophobizing treatment with dimethylpolysiloxane as fine silica particles B, 0.45 part of fine titanium oxide particles (product name: $TiO_2$—SDS, manufactured by Fuji Pigment Co., Ltd.) having a number average primary particle diameter of 15 nm were added to mix by means of a high speed agitator (product name: FM MIXER, manufactured by NIPPON COKE & ENGINEERING. CO., LTD.) and the external additives were externally added. Thus, a yellow toner 1 was produced. The characteristics of the yellow toner 1 are shown in Table 1.

Production Examples Y2 to Y5

Yellow toners 2 to 5 were produced in the same manner as in Production example Y1 except that the kind and added amount of the negative charge control resin, the negative charge control agent and the external additive were changed as shown in Table 1 in Production example Y1. The characteristics of the yellow toners 2 to 5 are shown in Table 1. Incidentally, the yellow toner 2 was obtained by using fine zinc oxide particles (product name: XZ-500F, manufactured by Sakai Chemical Industry Co., Ltd., with a hexagonal plate shape and an average long diameter of 450 nm). Further, the yellow toners 2 and 5 were obtained by using a negative charge control agent C (product name: BONTRON E-88, manufactured by Orient Chemical Industries Co., Ltd., a salicylic acid compound). In the yellow toners 4 and 5, as the fine silica particles A, fine silica particles a2 (product name: RX300, manufactured by Nippon Aerosil Co., Ltd.) having a number average primary particle diameter of 7 nm after being subjected to hydrophobizing treatment with silicone oil were used in place of the fine silica particles a1.

2-2. Production of Magenta Toner

Production Example M1

A magenta toner 1 was produced in the same manner as in Production example Y1 except that 7 parts of C. I. pigment yellow 155 as a yellow colorant was changed to 3 parts of C.I. pigment red 122 and 4 parts of C. I. pigment red 150 as a magenta colorant, the added amount of the negative charge control resin B was changed from 0.7 part to 0.4 part and the added amount of fine titanium oxide particles was changed from 0.45 part to 0.51 part in Production example Y1. The characteristics of the magenta toner 1 are shown in Table 1.

Production Examples M2 to M5

Magenta toners 2 to 5 were produced in the same manner as in Production example M1 except that the kind and added amount of the negative charge control resin, the negative charge control agent and the external additive were changed as shown in Table 1 in Production example M1. The characteristics of the magenta toners 2 to 5 are shown in Table 1. Incidentally the magenta toner 2 was obtained by using the fine zinc oxide particles (product name: XZ-500F). Further, the magenta toners 2 and 5 were obtained by using the above negative charge control agent C (product name: BONTRON E-88). Further, the magenta toners 4 and 5 were obtained by using the fine silica particles a2 (product name: RX300) as fine silica particles A.

2-3. Production of Cyan Toner

Production Example C1

A cyan toner 1 was produced in the same manner as in Production example Y1 except that 7 parts of C.I. pigment yellow 155 as a yellow colorant was changed to 5 parts of C.I. pigment blue 15:3 as a cyan colorant, the added amount of the negative charge control resin B was changed from 0.7 part to 0.5 part and the added amount of fine titanium oxide particles was changed from 0.45 part to 0.47 part in Production example Y1. The characteristics of the cyan toner 1 are shown in Table 1.

Production Examples C2 to C5

Cyan toners 2 to 5 were produced in the same manner as in Production example C1 except that the kind and added amount of the negative charge control resin, the negative charge control agent and the external additive were changed as shown in Table 1 in Production example C1. The characteristics of the cyan toners 2 to 5 are shown in Table 1. Incidentally, the cyan toner 2 was obtained by using the fine zinc oxide particles (product name: XZ-500F). Further, the cyan toners 2 and 5 were obtained by using the negative charge control agent C (product name: BONTRON E-88). Further, the cyan toners 4 and 5 were obtained by using the fine silica particles a2 (product name: RX300) as fine silica particles A.

3. Evaluation of Characteristics of Colored Resin Particles and Toners

The characteristics of the yellow toners 1 to 5, magenta toners 1 to 5 and cyan toners 1 to 5 as well as the colored resin particles used to produce these toners were examined. The details are as follows. The evaluation results are shown in Table 1.

(1) Measurement of Particle Diameter of Colored Resin Particles

The volume average particle diameter Dv, number average particle diameter Dn, and particle size distribution Dv/Dn of the colored resin particles were measured with a particle diameter measuring device (product name: MULTISIZER; manufactured by Beckman Coulter, Inc.). The measurement using the MULTISIZER was conducted under the conditions of: aperture diameter: 100 μm; dispersion medium: ISOTON II (product name); concentration: 10%; and number of the measured particles: 100,000. Specifically, 0.2 g of a colored resin particle sample was placed in a beaker. Then, a solution of alkylbenzene sulfonate (product name: DRIWEL; manufactured by FUJIFILM Corporation) was added therein as a dispersant. Further, 2 mL of the dispersion medium was added to the beaker to allow the toner to be wet. Then, 10 mL of the dispersion medium was added and dispersed with an ultrasonic disperser for 1 minute. After that, the measurement using the particle diameter measuring device was performed.

(2) Calculation of Average Circularity of Colored Resin Particles

The average circularity of colored resin particles is a value obtained by measuring the particles in an aqueous dispersion using a flow-type particle image analyzer (FPIA-1000; manufactured by Sysmex Corporation). In the measurement method, 10 mL of ion exchange water was previously poured into a container. As a dispersant, a surfactant, preferably alkylbenzene sulfonate was added thereto and 0.2 g of measurement sample was added thereto. Then, the resultant mixture was dispersed uniformly.

Then, dispersion treatment was performed by means of an ultrasonic disperser at 60 W for 3 minutes. The concentration of the colored resin particles at the time of measurement was adjusted so as to reach a range of 3,000 to 10,000 particle/μL. The circularity of 1,000 to 10,000 colored resin particles was measured. The average circularity was calculated using this data.

(3) Measurement of q/d for any of Toners and Calculation of Average of q/d and Standard Deviation (SD)

9.5 g of a non-coated Mn—Mg—Sr based ferrite carrier (product name: EF-80, manufactured by Powdertech Co., Ltd.) and 0.5 g of a toner sample were weighed, which put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%. The obtained ferrite carrier and toner were subjected to measurement using an electric field detachment-type charge amount distribution measurement device (product name: Q-TEST, manufactured by Epping PES-Laboratorium) in order to measure a q/d for any of the toners which is expressed by charge amount q (fC) and particle diameter d (μm). Then, an average of q/d and a standard deviation (SD) of q/d were calculated. The measurement conditions are as follows:

Airflow: 160 mL/min

Applied voltage: 4,000 V

The evaluation results of the yellow toners 1 to 5, magenta toners 1 to 5 and cyan toners 1 to 5 are shown in Table 1 below together with the kind and added amount of the negative charge control resins, the negative charge control agents and the external additives.

TABLE 1

| Yellow toner | | | 1 | 2 | 3 | 4 | 5 |
|---|---|---|---|---|---|---|---|
| CCA | Negative charge control resin A | Added amount (part) | 1.5 | 1.5 | 0.5 | — | — |
| | Negative charge control resin B | Added amount (part) | 0.7 | — | 1.2 | 1 | — |
| | Negative charge control agent C | Added amount (part) | — | 1.1 | — | — | 2.5 |
| External additive | Fine silica particles A | Number average primary particle diameter (nm) | 16 | 16 | 16 | 7 | 7 |
| | | Added amount (part) | 0.4 | 0.4 | 0.8 | 0.4 | 0.4 |
| | Fine silica particles B | Number average primary particle diameter (nm) | 45 | 45 | 45 | 45 | 45 |
| | | Added amount (part) | 1.2 | 1.0 | 1.5 | 1.2 | 1.2 |
| | Fine titanium oxide particles | Number average primary particle diameter (nm) | 15 | — | — | — | — |
| | | Added amount (part) | 0.45 | — | — | — | — |
| | Fine zinc oxide particles | Average long diameter (nm) | — | 450 | — | — | — |
| | | Added amount (part) | — | 0.25 | — | — | — |
| Toner characteristics | Volume average particle diameter Dv (μm) | | 6.8 | 6.8 | 6.4 | 6.6 | 7.0 |
| | Particle size distribution Dv/Dn | | 1.14 | 1.12 | 1.17 | 1.21 | 1.25 |
| | Average circularity | | 0.981 | 0.984 | 0.976 | 0.974 | 0.977 |
| | Average value of q/d (fC/10 um) | | −3.5 | −2.5 | −6.2 | −8.3 | −5.3 |
| | Standard deviation of q/d (SD) (fC/10 μm) | | 2.1 | 3.6 | 12.7 | 15.3 | 13.9 |

| Magenta toner | | | 1 | 2 | 3 | 4 | 5 |
|---|---|---|---|---|---|---|---|
| CCA | Negative charge control resin A | Added amount (part) | 1.5 | 1.5 | 0.5 | — | — |
| | Negative charge control resin B | Added amount (part) | 0.4 | — | 0.7 | 1 | — |
| | Negative charge control agent C | Added amount (part) | — | 0.9 | — | — | 2.5 |
| External additive | Fine silica particles A | Number average primary particle diameter (nm) | 16 | 16 | 16 | 7 | 7 |
| | | Added amount (part) | 0.4 | 0.4 | 0.8 | 0.4 | 0.4 |
| | Fine silica particles B | Number average primary particle diameter (nm) | 45 | 45 | 45 | 45 | 45 |
| | | Added amount (part) | 1.2 | 1.0 | 1.5 | 1.2 | 1.2 |
| | Fine titanium oxide particles | Number average primary particle diameter (nm) | 15 | — | — | — | — |
| | | Added amount (part) | 0.51 | — | — | — | — |
| | Fine zinc oxide particles | Average long diameter (nm) | — | 450 | — | — | — |
| | | Added amount (part) | — | 0.32 | — | — | — |

TABLE 1-continued

| | | | | | | | |
|---|---|---|---|---|---|---|---|
| Toner characteristics | Volume average particle diameter Dv (μm) | | 6.9 | 6.8 | 6.6 | 6.8 | 6.9 |
| | Particle size distribution Dv/Dn | | 1.13 | 1.13 | 1.16 | 1.25 | 1.24 |
| | Average circularity | | 0.983 | 0.982 | 0.978 | 0.972 | 0.978 |
| | Average value of q/d (fC/10 um) | | −2.8 | −2.4 | −4.7 | −7.5 | −4.7 |
| | Standard deviation of q/d (SD) (fC/10 μm) | | 2.7 | 3.8 | 9.2 | 19.2 | 14.5 |
| Cyan toner | | | 1 | 2 | 3 | 4 | 5 |
| CCA | Negative charge control resin A | Added amount (part) | 1.5 | 1.5 | 0.5 | — | — |
| | Negative charge control resin B | Added amount (part) | 0.5 | — | 0.8 | 1 | — |
| | Negative charge control agent C | Added amount (part) | — | 0.7 | — | — | 2.5 |
| External additive | Fine silica particles A | Number average primary particle diameter (nm) | 16 | 16 | 16 | 7 | 7 |
| | | Added amount (part) | 0.4 | 0.4 | 0.8 | 0.4 | 0.4 |
| | Fine silica particles B | Number average primary particle diameter (nm) | 45 | 45 | 45 | 45 | 45 |
| | | Added amount (part) | 1.2 | 1.0 | 1.5 | 1.2 | 1.2 |
| | Fine titanium oxide particles | Number average primary particle diameter (nm) | 15 | — | — | — | — |
| | | Added amount (part) | 0.47 | — | — | — | — |
| | Fine zinc oxide particles | Average long diameter (nm) | — | 450 | — | — | — |
| | | Added amount (part) | — | 0.36 | — | — | — |
| Toner characteristics | Volume average particle diameter Dv (μm) | | 6.9 | 6.7 | 6.7 | 6.4 | 7.4 |
| | Particle size distribution Dv/Dn | | 1.13 | 1.12 | 1.16 | 1.24 | 1.22 |
| | Average circularity | | 0.982 | 0.982 | 0.977 | 0.974 | 0.978 |
| | Average value of q/d (fC/10 um) | | −2.5 | −3.2 | −5.9 | −5.8 | −4.1 |
| | Standard deviation of q/d (SD) (fC/10 μm) | | 1.8 | 1.9 | 10.5 | 16.3 | 15.2 |

4. Preparation of Toner Sets

Examples 1 to 3 and Comparative Examples 1 to 3

A toner was selected from yellow, magenta, and cyan toners and combined with each other as shown in Table 2 below and toner sets of Examples 1 to 3 and comparative examples 1 to 3 were prepared.

5. Evaluation of Characteristics of Toner Sets

Regarding the toner sets of Examples 1 to 3 and Comparative examples 1 to 3, the characteristics in the case of superimposing the toners of each color were examined. The details are as follows. The evaluation results are shown in Table 2.

(1) Fine Line Reproducibility (Color Superimposing)

In a fine line reproducibility test, a commercially-available, non-magnetic one-component development printer (printing speed: 20 A4 sheets/min) was used. The toner was charged into the toner cartridge of the development device, and then printing paper were set in the device.

After being left for 24 hours in a normal temperature and normal humidity (N/N) environment at a temperature of 23° C. and a humidity of 50%, a 2×2 dot line (about 85 μm in width) image was continuously formed in the same environment and 10,000 printing sheets were continuously printed. At this time, the dot line was printed in each of red, green and blue using yellow, magenta and cyan toners.

The concentration distribution data of the line images was collected every 500 prints by means of a printing evaluation system (product name: RT2000; manufactured by YA-MA, Inc.). When defining the full width of an line image having a concentration being half value of the maximum concentration in the collected concentration distribution data of line images as a target line width, and using a line width formed on the printing paper which was firstly collected as a reference, the line image maintaining the difference of the line widths of 10 μm or less was considered to reproduce the line width formed on the firstly collected printing paper, and the number of printing paper of continuous printing, which can maintain the difference between the target line width and the reference line width to be 10 μm or less, was counted. The number of prints in which at least one of red, green, and blue dot lines cannot be maintained such that the difference between the line widths was 10 μm or less, was defined as the number of printing paper for fine line reproducibility evaluation.

(2) Color Reproducibility (Color Superimposing)

The fine line reproducibility as well as the color reproducibility after the printing test were evaluated. Red, green, and blue color tones were measured using a spectrophotometer (product name: SPECTROEYE, manufactured by GretagMacbeth).

Based on the difference between the color tone after printing 500 sheets and the color tone at the end of the durable printing, the ΔE in the dot line of each of the colors was calculated and the color reproducibility was compared. At this time, among red, green, and blue dot lines, the dot line exhibiting the highest ΔE was defined as a value for color stability evaluation. As this value is smaller, the color stability is evaluated to be high.

The evaluation results of the toner sets of Examples 1 to 3 and Comparative examples 1 to 3 are shown in Table 2 below together with the evaluation of the toner of each color. Incidentally, the "maximum (Δq/d)" in Table 2 below means a maximum (Δq/d) of a difference (Δq/d) between average values of q/d for yellow and cyan toners, a difference (Δq/d) between average values of q/d for yellow and magenta toners and a difference (Δq/d) between average values of q/d for cyan and magenta toners. Further, the "maximum (ΔSD)" in Table 2 below means a maximum (ΔSD) of a difference (ΔSD) between standard deviations of q/d for yellow and cyan toners, a difference (ΔSD) between standard deviations of q/d for yellow and magenta toners and a difference (ΔSD) between standard deviations of q/d for cyan and magenta toners.

TABLE 2

| | Example 1 | | | Example 2 | | | Example 3 | | |
|---|---|---|---|---|---|---|---|---|---|
| | Y1 | M1 | C1 | Y2 | M2 | C2 | Y3 | M3 | C3 |
| Average value of q/d (fC/10 μm) | −3.5 | −2.8 | −2.5 | −2.5 | −2.4 | −3.2 | −6.2 | −4.7 | −5.9 |
| Standard deviation of q/d (SD) (fC/10 μm) | 2.1 | 2.7 | 1.8 | 3.6 | 3.8 | 1.9 | 12.7 | 9.2 | 10.5 |
| Maximum Δq/d (fC/10 μm) | | 1.0 | | | 0.8 | | | 1.5 | |
| Maximum ΔSD (fC/10 μm) | | 0.9 | | | 1.9 | | | 3.5 | |
| Fine line reproducibility (color superimposing) (sheet) | | 10000 | | | 10000< | | | 8000 | |
| Color reproducibility (color superimposing) | | 2 | | | 3 | | | 5 | |

| | Comparative example 1 | | | Comparative example 2 | | | Comparative example 3 | | |
|---|---|---|---|---|---|---|---|---|---|
| | Y4 | M4 | C4 | Y5 | M5 | C5 | Y1 | M3 | C3 |
| Average value of q/d (fC/10 μm) | −8.3 | −7.5 | −5.8 | −5.3 | −4.7 | −4.1 | −3.5 | −4.7 | −5.9 |
| Standard deviation of q/d (SD) (fC/10 μm) | 15.3 | 19.2 | 16.3 | 13.9 | 14.5 | 15.2 | 2,1 | 9.2 | 10.5 |
| Maximum Δq/d (fC/10 μm) | | 2.5 | | | 1.2 | | | 2.4 | |
| Maximum ΔSD (fC/10 μm) | | 3.9 | | | 1.3 | | | 8.4 | |
| Fine line reproducibility (color superimposing) (sheet) | | 5000 | | | 3000 | | | 2000 | |
| Color reproducibility (color superimposing) | | 8 | | | 12 | | | 16 | |

6. Evaluation of Toners

Hereinafter, the evaluation results of the toners and the toner sets will be examined with reference to Table 2.

Table 2 shows that, as for the toners used in Comparative example 1, an absolute value of an average of q/d for a the yellow toner 4 (Y4) is 8.3 fC/10 μm and a standard deviation (SD) of q/d for yellow toner 4 (Y4) is 15.3 fC/10 μm, an absolute value of an average of q/d for the magenta toner 4 (M4) is 7.5 fC/10 μm and a standard deviation (SD) of q/d for magenta toner 4 (M4) is 19.2 fC/10 μm, and an absolute value of an average of q/d for the cyan toner 4 (C4) is 5.8 fC/10 μm and a standard deviation (SD) of q/d for cyan toners is 16.3 fC/10 μm. Further, regarding the toner set of Comparative example 1, the maximum difference (Δq/d) is 2.5 fC/10 μm and the maximum difference (ΔSD) is 3.9 fC/10 μm.

Table 2 shows that in Comparative example 1, the number of printing paper for fine line reproducibility evaluation in the case of superimposing the three color toners is as small as 5,000, whereas the value of the color reproducibility in the case of superimposing the three color toners is as large as 8. This is assumed to be due to the fact that the absolute value of an average of q/d for each of the toners Y4 and M4 is larger than 6.5 fC/10 μm, the standard deviation (SD) of q/d for any of the three color toners is larger than 13, and further the maximum difference (Δq/d) is larger than 2.0 fC/10 μm, and as a result, the transferring characteristics of any of the color toners are mainly reduced, and the fine line reproducibility and the color stability in the case of superimposing the three color toners are poor.

Table 2 shows that, as for the toners used in Comparative example 2, an absolute value of an average of q/d for the yellow toner 5 (Y5) is 5.3 fC/10 μm and a standard deviation (SD) of q/d for yellow toner 5 (Y5) is 13.9 fC/10 μm, an absolute value of an average of q/d for the magenta toner 5 (M5) is 4.7 fC/10 μm and a standard deviation (SD) of q/d for magenta toner 5 (M5) is 14.5 fC/10 μm, and an absolute value of an average of q/d for the cyan toner 5 (C5) is 4.1 fC/10 μm and standard deviation (SD) of q/d for cyan toner 5 (C5) is 15.2 fC/10 μm. Further, regarding the toner set of Comparative example 2, the maximum difference (Δq/d) is 1.2 fC/10 μm and the maximum difference (ΔSD) is 1.3 fC/10 μm.

Table 2 shows that in Comparative example 2, the number of printing paper for fine line reproducibility evaluation in the case of superimposing the three color toners is as small as 3,000, whereas the value of the color reproducibility in the case of superimposing the three color toners is as large as 12. This is assumed to be due to the fact that the standard deviation (SD) of q/d for each of the three color toners is larger than 13 fC/10 μm, and as a result, the developing characteristics and transferring characteristics of any of the color toners are reduced, and the fine line reproducibility and the color stability in the case of superimposing the three color toners are poor.

Table 2 shows that, as for the toners used in Comparative example 3, an absolute value of an average of q/d for the yellow toner 1 (Y1) is 3.5 fC/10 μm and a standard deviation (SD) of q/d for yellow toner 1 (Y1) is 2.1 fC/10 μm, an absolute value of an average of q/d for the magenta toner 3 (M3) is 4.7 fC/10 μm and a standard deviation (SD) of q/d for magenta toner 3 (M3) is 9.2 fC/10 μm, and an absolute value of an average of q/d for the cyan toner 3 (C3) is 5.9 fC/10 μm and a standard deviation (SD) of q/d for cyan toner 3 (C3) is 10.5 fC/10 μm. Further, regarding the toner set of Comparative example 3, the maximum difference (Δq/d) is 2.4 fC/10 μm and the maximum difference (ΔSD) is 8.4 fC/10 μm.

Table 2 shows that in Comparative example 3, the number of printing paper for fine line reproducibility evaluation in the case of superimposing the three color toners is as small as 2,000, whereas the value of the color reproducibility in the case of superimposing the three color toners is as large as 16. Particularly, the number of prints for fine line reproducibility evaluation in Comparative example 3 is the smallest among the toner set evaluated this time. The value of the color reproducibility in Comparative example 3 is the largest among the toner set evaluated this time. This is assumed to be due to the fact that the maximum difference (Δq/d) is larger than 2.0 fC/10 μm and the maximum difference (ΔSD) is larger than 5.0 fC/10 μm, and as a result, the developing characteristics and transferring characteristics of any of the color toners are reduced, particularly in a period of duration, and the fine line reproducibility and the color stability in the case of superimposing the three color toners are poor.

On the other hand, Table 2 shows that, as for the toners used in Examples 1 to 3, an absolute value of an average of q/d for any of the yellow toners 1 to 3 (Y1 to Y3) is from 2.5 to 6.2 fC/10 μm and a standard deviation (SD) of q/d for yellow toners 1 to 3 (Y1 to Y3) is 2.1 to 12.7 fC/10 μm, an absolute value of an average of q/d for any of the magenta toners 1 to 3 (M1 to M3) is from 2.4 to 4.7 fC/10 μm and a standard deviation (SD) of q/d for magenta toners 1 to 3 (M1 to M3) is from 2.7 to 9.2 fC/10 μm, and an absolute value of an average of q/d for any of the cyan toners 1 to 3 (C1 to C3) is from 2.5 to 5.9 fC/10 μm and a standard deviation (SD) of q/d for the cyan toners 1 to 3 (C1 to C3) is from 1.8 to 10.5 fC/10 μm. Further, regarding each of the toner sets of Examples 1 to 3, the maximum difference (Δq/d) is from 0.8 to 1.5 fC/10 μm and the maximum difference (ΔSD) is 0.9 to 3.5 fC/10 μm.

Table 2 shows that when the three color toners are superimposed in Examples 1 to 3, the number of printing paper for fine line reproducibility evaluation is large (8,000 or more), whereas the value of the color reproducibility in the case of superimposing the three toners is small (5 or less).

Therefore, it is found that the toner set of the present invention, in which an absolute value of an average of q/d for any of the toners is in a range of 2.0 to 6.5 fC/10 μm, and a standard deviation (SD) of q/d for any of the toners is 13 fC/10 μm or less, and further the maximum difference (Δq/d) is 2.0 fC/10 μm or less and the maximum difference (ΔSD) is 5.0 fC/10 μm or less, is excellent in fine line reproducibility and color stability even if the three color toners are superimposed and printed.

The invention claimed is:

1. A toner set comprising a yellow toner, a cyan toner and a magenta toner, the toners each comprising an external additive and colored resin particles comprising a binder resin, a colorant and a charge control agent, wherein an absolute value of an average of q/d for any of the yellow, cyan and magenta toners which is expressed by charge amount q (fC) and particle diameter d (μm) and which is obtained by measurement using an electric field detachment-type charge amount distribution measurement device after the following frictional charge treatment, is in a range of 2.0 to 6.5 fC/10 μm, and a standard deviation (SD) of q/d for any of the yellow, cyan and magenta toners is 13 fC/10 μm or less;

wherein a difference (Δq/d) between average values of q/d for any two of the yellow, cyan and magenta toners is 2.0 fC/10 μm or less, and a difference (ΔSD) between standard deviations of q/d for the two toners is 5.0 fC/10 μm or less:

[Frictional Charge Treatment]

first, 9.5 g of a non-coated Mn—Mg—Sr based ferrite carrier and 0.5 g of a toner to be measured are put in a 30 cc glass container (inner base diameter 31 mm, height 54 mm) and the glass container is rotated with a roller-type agitator at 150 rpm for 30 minutes to frictionally charge the toner in an environment at a temperature of 23° C. and a relative humidity of 50%;

wherein the yellow toner, the cyan toner and the magenta toner are negatively-chargeable toners; and wherein, with respect to 100 parts by mass of the colored resin particles, the external additive comprises 0.1 to 1 part by mass of fine titanium oxide particles having a number average primary particle diameter of 10 to 90 nm.

2. The toner set according to 1, wherein, with respect to 100 parts by mass of the colored resin particles, the external additive further comprises 0.1 to 1.5 parts by mass of fine zinc oxide particles having an average long diameter of 50 to 2,000 nm.

* * * * *